US005263840A

United States Patent [19]

Heitmann et al.

[11] Patent Number: 5,263,840

[45] Date of Patent: Nov. 23, 1993

[54] CALENDAR FOR SURFACE TREATMENT OF MATERIAL WEBS

[75] Inventors: Peter Heitmann, Weingarten; Karl Volz, Baindt, both of Fed. Rep. of Germany

[73] Assignee: Sulzer-Escher Wyss GmbH, Ravensburg, Fed. Rep. of Germany

[21] Appl. No.: 975,896

[22] Filed: Nov. 13, 1992

Related U.S. Application Data

[63] Continuation of Ser. No. 603,798, Oct. 25, 1990, abandoned.

[30] Foreign Application Priority Data

Oct. 30, 1989 [DE] Fed. Rep. of Germany ..... 3936128

[51] Int. Cl.[5] ..... B30B 3/04

[52] U.S. Cl. ..... 425/363; 100/170; 264/175; 264/284; 264/293; 425/366; 425/367; 425/DIG. 235; 492/2; 492/5; 492/7

[58] Field of Search ..... 425/224, 335, DIG. 235, 425/363, 367, 327, 141, 384, 385, 394, 366, 130; 264/40.5, 175, 284, 293; 100/170; 492/2, 5, 6, 7, 9, 10

[56] References Cited

U.S. PATENT DOCUMENTS

| | | | |
|---|---|---|---|
| 3,006,225 | 10/1961 | Mamas | 425/367 |
| 3,016,819 | 1/1962 | Kupka | 425/DIG. 235 |
| 3,445,070 | 5/1969 | Verdier | 100/170 |
| 3,600,747 | 8/1971 | McCarty | 425/162 |
| 3,964,848 | 6/1976 | Wockener | 425/224 |
| 4,256,448 | 3/1981 | Carle | 425/143 |
| 4,290,353 | 9/1981 | Pav et al. | 492/7 |
| 4,311,658 | 1/1982 | Nicoll | 264/175 |
| 4,389,933 | 6/1983 | Pav | 492/7 |
| 4,519,757 | 5/1985 | Wittkopf et al. | 425/143 |
| 4,520,723 | 6/1985 | Pav et al. | 492/20 |
| 4,695,239 | 9/1987 | Klepsch et al. | 425/367 |
| 4,810,179 | 3/1989 | Cavanaugh | 425/141 |

*Primary Examiner*—David A. Simmons
*Assistant Examiner*—W. J. Matney, Jr.
*Attorney, Agent, or Firm*—Wolf, Greenfield & Sacks

[57] ABSTRACT

A calender for surface treatment of material webs, wherein in the event of one sided seizure of an intermediate roller the fixed roller not subject to pressure is adjusted in position at one end such that the asymmetrical linear force profile resulting from the seizure is symmetrically adjusted according to the desired condition in order to optimise processing of the material web.

15 Claims, 3 Drawing Sheets

CALENDAR FOR SURFACE TREATMENT OF MATERIAL WEBS

Figure 1A:
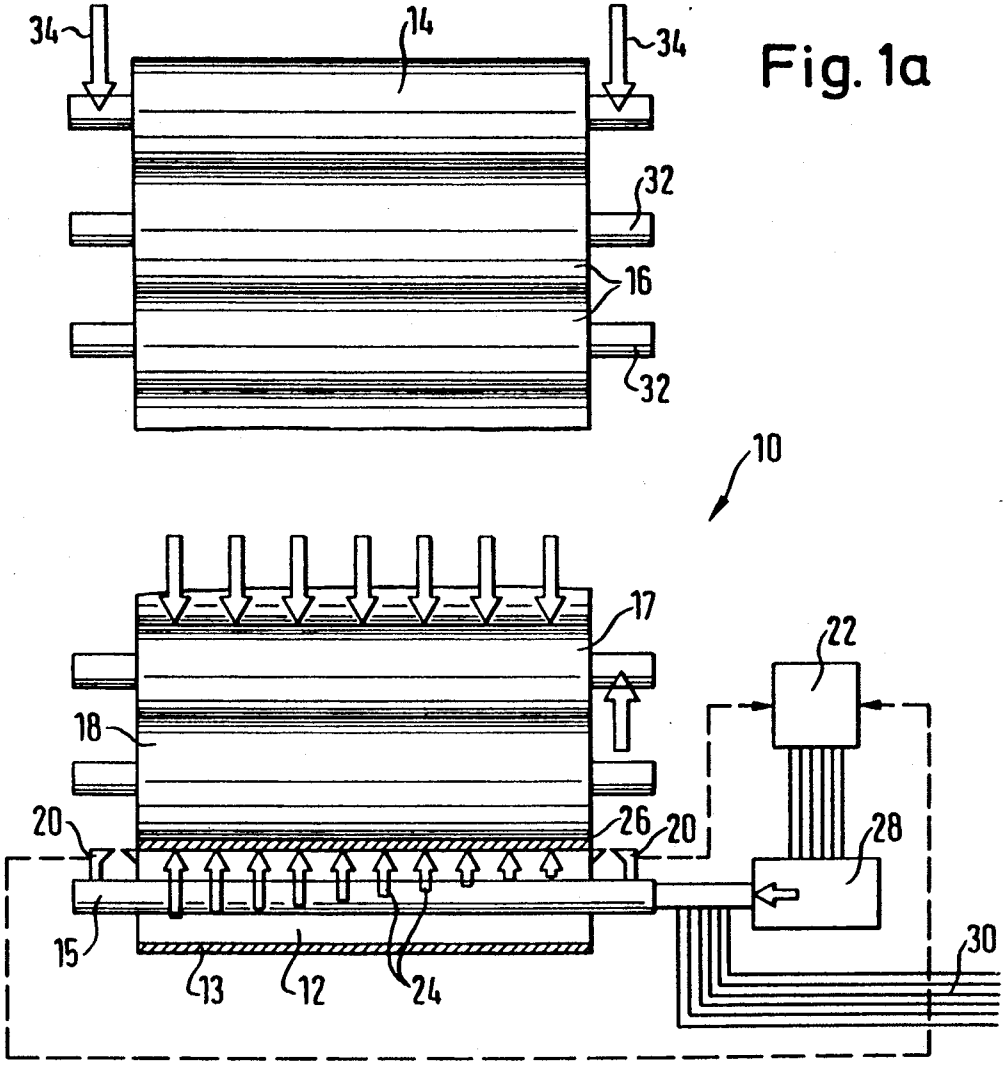

This application is a continuation of application Ser. No. 07/603,798 filed Oct. 25, 1990, now abandoned.

The invention relates to a calender for treating material webs, comprising at least one fixed roller which in operation is fixedly supported in the pressing direction and at least one movable roller which is mounted for free movement in the pressing direction.

Such calenders are fairly well known. In particular, the roller journals are mounted in elongate guides for free movement in the pressing direction, so that they function as movable rollers and are subject to limited movement in these guides.

In this connection, problems arise from the fact that considerable frictional forces can act in these guides even to the extent of a more or less seizing effect. As a result, for example with a vertically extending calender, the expected pressing force in the roller gap of the fixed roller can possibly be too high or too low on one side, according to whether an increase or decrease of the pressing force was executed. This leads to pressing forces deviating from the desired value and/or to inclined press force profiles in the roller gap, the latter occurring since the friction forces are not always equally large in the roller guides.

It has already been attempted many times to moderate the effect of these frictional or seizing phenomena by artificial shaking or moving of the entire roller assembly in order to loosen the frictional forces. Also it has been attempted to provide a remedy in that according to circumstances a greater or smaller additional load is applied by the movable roller until the desired pressing forces are present at the fixed roller.

In this way, it is partially achieved that with approximately constant friction, the actual value of the central line force or the central line force profile in the roller gap on the fixed roller, taken as a measure of the smoothing process, is brought to the desired value. In many cases however it occurred that the friction was increased until the guide seized as a direct result of the mentioned techniques. In every case the line forces in the roller gaps, which are located between the rubbing or seizing roller and the moving roller experiencing the additional loading, are incorrect which leads to a considerable disturbance of the rolling process.

Therefore, the object of the invention consists in providing a calender in which the mentioned friction and seizing are avoided in a simple and reliable manner, or at least in which their disadvantageous effect can be mitigated without for example having to alter considerably an existing calender.

This object is achieved according to the invention by an arrangement for measuring the pressing forces on the fixed roller 12, an arrangement for adjusting the fixed roller 12 in the pressing direction, an arrangement for comparing the desired value of the pressing force with the actual measured pressing force on the fixed roller, and a control device for controlling the adjusting arrangement according to the comparison between the actual and desired values for achieving the desired pressing forces on the fixed roller in the roller gap. The desired value of the pressing force on the fixed roller is thus derived from the components of the weight forces acting in the pressing direction of the supporting parts movable across the fixed roller in the pressing direction as well as the forces impressed on the displaceable rollers.

This solution makes use of the idea of making the roller provided as such for operating as a fixed roller at least selectively movable at the ends in the pressing direction, in dependence upon the supporting forces measured at the fixed roller, which are largely determined by the pressing forces. The claimed principle operates generally both upwardly and also downwardly (vertically extending calender) and also in any other relative position of the rollers, as for example horizontally where the calender is horizontal. In this connection, a supplementary load can be applied both from above and also from below or from right or left.

With use of the invention, the disadvantage effect of the frictional forces can be avoided not only on the adjusted fixed roller but also in the roller gaps between the adjusted fixed roller and the roller on which the harmful frictional force appears.

According to the invention it is not necessary to know which of the rollers is rubbing or seizing in its guides.

As the smallest unit, one fixed roller can be combined with one movable roller.

Also movable rollers, which exert supplementary forces are conceivable.

In conjunction with an upright calender, the fixed roller can be provided either as the uppermost or as the lowermost roller.

In conjunction with a horizontal calender, the fixed roller can be provided either as the outermost right hand or the outermost left hand roller.

It is also possible to provide the fixed roller in the intermediate region of the calender.

The fixed roller itself can expediently be constructed as a deflecting equalization roller with fixed lateral bearings of the roller sleeve (so-called NIPCO-K roller).

Also the fixed roller can be constructed as a deflecting equalization roller with a roller sleeve movable in the pressing direction over its entire length, which sleeve can be fixed by a distance measuring arrangement at a selectable position for operation in the pressing direction (so-called NIPCO-F roller with position control).

The movable roller, which can apply supplementary forces, is advantageously conceivable as a deflecting equalization roller with a roller sleeve movable in the pressing direction.

For measuring the load on the rollers, load cells can be employed or also hydraulic or pneumatic pressures can be derived from the loading systems of the rollers.

For changing the position of the front ends of the respective fixed roller, jacking devices, piston systems or other mechanical arrangements can be used.

In conjunction with a fixed roller as deflecting equalization roller with a roller sleeve movable in the pressing direction over the entire length, which sleeve can be fixed by means of a distance measuring arrangement at a selectable position for operating in the pressing direction, the said adjustment can be performed by modifying the selectable position, e.g. by appropriate inputs into a controller fixing the position of the roller sleeve, or by modifying the position of the entire deflecting equalization roller. Another possible technique is to reduce artificially the clearance at the distance measuring arrangement and thus to initiate readjustment.

Readjustment of the position of the fixed roller towards or away from the rubbing or seizing roller can be separately automated at both roller ends in dependence upon the actual-desired pressure force difference between the fixed and movable rollers.

Further advantageous configurations appear from the subsidiary claims.

Figure 1B:
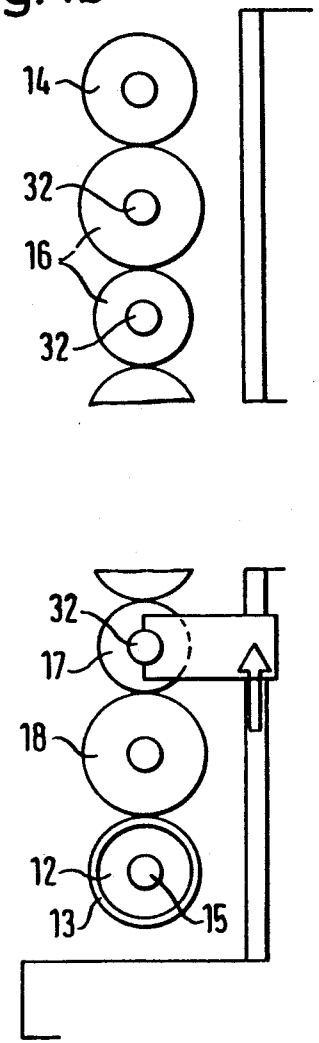

The invention will now be described in the following in more detail on the basis of exemplary embodiments illustrated purely schematically in the drawings, in which:

FIG. 1*a* shows a schematic view of a calender;

FIG. 1*b* shows a schematic side view of the calender according to FIG. 1*a;*

Figure 2A:
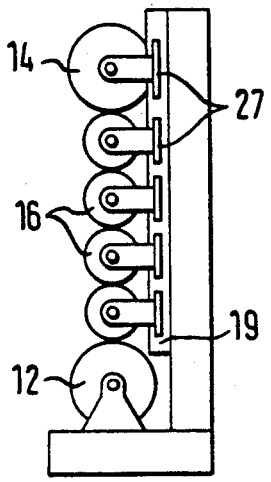
Figure 2B:
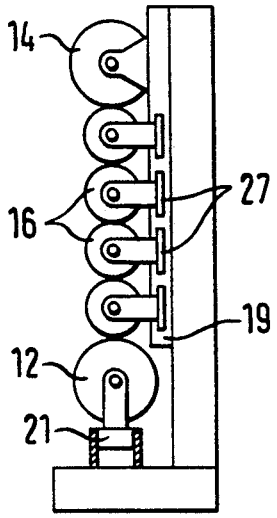
Figure 2C:
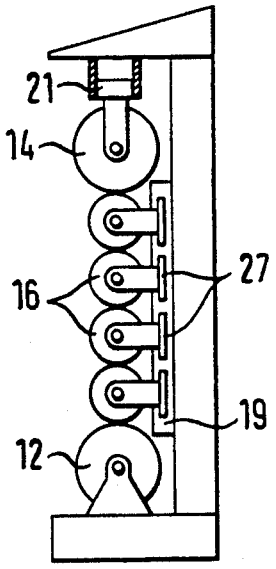
Figure 2D:
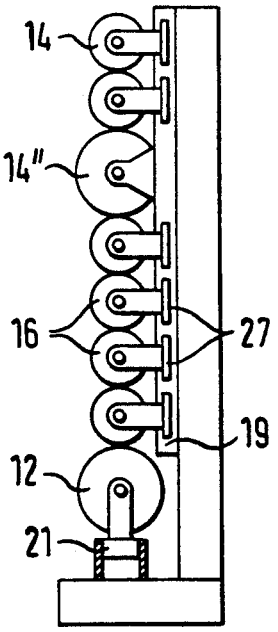
Figure 2E:
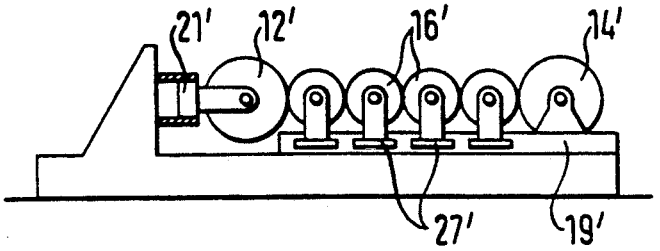
Figure 3A:
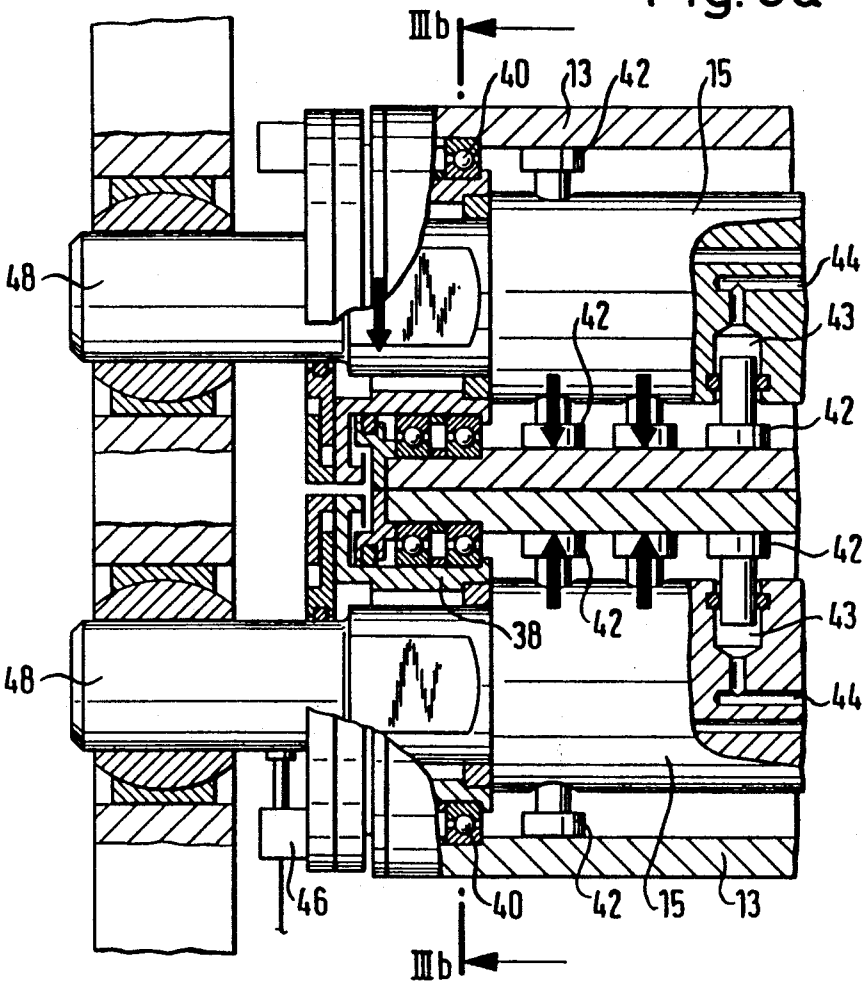
Figure 3B:
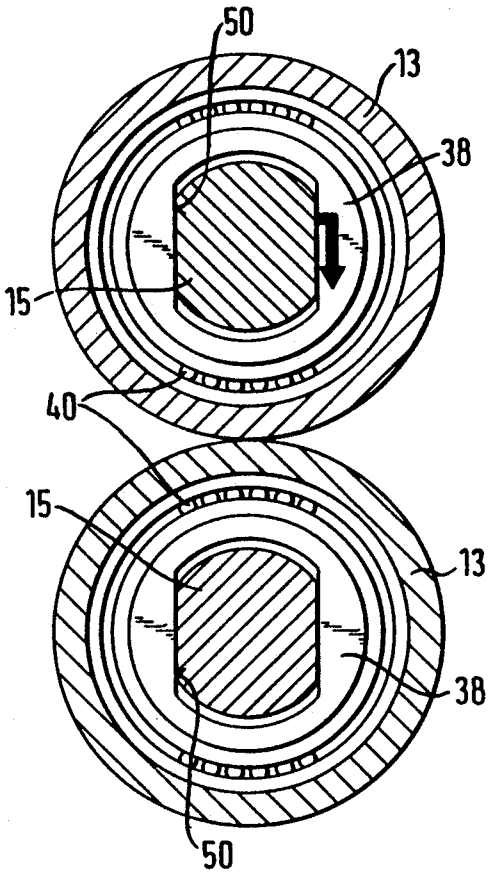

FIGS. 2*a* to 2*e* show various upright calenders and a horizontal calender; and FIGS. 3*a* and 3*b* show a two roller construction in longitudinal and transverse section.

A calender consists of a plurality of rollers arranged behind one another which form a roller gap therebetween, through which passes the paper web to be smoothed. With an upright calender according to FIGS. 1*a* and 1*b*, a lower roller 12 and an upper roller 14 are provided with intermediate rollers 16, 17 and 18 arranged therebetween. A portion of the intermediate rollers is not illustrated in FIG. 1*a*. Although either the upper or the lower roller or even an intermediate roller can be provided as a so-called fixed roller, in the example illustrated in FIG. 1*a*, the lower roller 12 is constructed as a so-called NIPCO roller having a roller sleeve 13 and a yoke 15. This roller here represents a so-called fixed roller. These NIPCO rollers can be constructed in various ways. To form a so-called NIPCO-K roller, the roller sleeve 12 is itself mounted laterally and bending equalization of the sleeve takes place by means of intermediate supports which can be loaded using hydraulic oil. With the so-called NIPCO-F roller, the roller sleeve is no longer laterally supported, but rather the support takes place only over the length of the roller sleeve on the yoke. Such a NIPCO roller is a known deflection equalization roller.

On the roller sleeve 13 or on the yoke 15 is located a position sensor 20 which is coupled to a position controller 22. The deflection equalization supports represented by the arrows 24 are supplied with hydraulic oil in order to apply differential pressure on a linear force profile in the roller gap 26 between the intermediate roller 18 and the lower fixed roller 12 across the length of the roller. The control of the hydraulic oil pressure is performed by means of an oil pressure controller 28 coupled to the position controller. The oil pressure at various positions of the roller gap can be displayed graphically on a monitor via lines 30.

The position sensor 20 reports the actual position of the NIPCO roller sleeve 13 to the position controller 22 which continuously corrects the oil pressure of all zones in such a manner that the NIPCO roller sleeve 13, and thus the entire roller assembly assumes a definite horizontal height position and maintains it. The entire roller assembly floats as it were within quite narrow limits.

The rollers are guided by lateral journals 32 engaging in vertical guides. The rollers normally lie on one another in the vertical calender as a result of the weight of the rollers themselves. However, also according to the arrows 34 a supplementary pressure can be applied laterally to the upper roller 14. In this connection, the upper roller 14 can likewise be a NIPCO roller.

If for example seizure occurs on the right hand side in the vertical guide of intermediate roller 17, this results in upward deflection of the roller sleeve 13 (NIPCO sleeve) so that the position sensor 20 on the right hand side in FIG. 1 experiences distancing in the vertical direction between the associated sensor components. Thus, on the seizing side the position sensor registers the reduced loading as a small upward movement of the sleeve and thus controls a correspondingly reduced oil pressure on this side. The linear forces now applied by the self-loading NIPCO roller uniformly increase from the side where seizing occurs up to full loading on the opposite side which is displayed as an inclined linear force profile on the monitor via the lines 30. A differing linear profile is illustrated by the arrows of differing length in the region of the NIPCO roller in FIG. 1*a*. According to the invention, the lower roller 12 arranged as a fixed roller on the right hand side, i.e. on the side of the seizure, is now moved upwardly in such manner that again a uniform linear force profile across the length of the roller is set according to the desired values. This means that the actual fixed roller is adjustable in the direction of the remaining rollers for re-regulation at least at the ends.

It should also be mentioned that in the event of seizure on the right hand side of the intermediate roller 17 the conditions above this roller remain satisfactory, as indicated by the arrows at that point in FIG. 1*a*. The conditions beneath the seizure are brought back to the desired condition by the regulation across the entire length of the rollers.

FIG. 2 shows in schematic representation vertical calenders in FIGS. 2*a* to 2*d* and a horizontal calender in FIG. 2*e*. In FIG. 2*a*, the rollers 14 and 16 are movable rollers which are guided by means of guide components 17 in vertical guides 19. The lower roller 12 is here a fixed roller.

In FIG. 2*b*, the upper roller 14 is fixed in just the same way as the lower roller 12, which however can here be moved by a jacking unit 21 for active pressure force application. Also this movement can be subject to seizure.

In FIG. 2*c*, the lower roller 12 is fixed, the upper roller 14 being movable vertically by a jacking unit 21 for pressure force application.

FIG. 2*d* shows how the calender in FIG. 2*b* may have a lower roller 12 movable by a jacking unit 21 as well as a fixed intermediate roller 14''.

In the horizontal calender of FIG. 2*e*, the right hand outer roller 14' is fixed and the outer left hand roller 12' is movable by a jacking unit 21'. The intermediate rollers 16' are likewise movable with guide components 27' in a guide 19'.

In order to simplify this system, a measurement can be performed separately at both ends of the fixed roller. In this connection, it is irrelevant whether the loading is applied by the self weight and an additional load above in the vertical calender or is applied by force application below. In each case it has to be ensured that, taking account of the desired loading, the actual loading appearing in the event of seizure possibly also on one side is eliminated and brought back to the desired value by slight movement of the fixed roller at the corresponding end. The hydraulic or pneumatic pressures of the pressure application system may for example serve as measures of the loadings.

The possibility also exists of determining the respective actual value in the region of the support of the fixed roller using load cells and then performing regulation to the desired value. For position change of the respective fixed roller, jacking devices, piston systems or other mechanical arrangements are suitable.

Also measuring and positioning systems can occur in combination, as for example the so-called "floating stack principle" with position sensors in combination with self-loading NIPCO rollers.

Readjustment of the position of the fixed roller towards or away from the rubbing roller can be automated in dependence upon the difference between the desired pressure deviation of the two extreme superimposed roller gaps, separately at both roller ends. For the system, it is not necessary to know which of the rollers is rubbing or seizing in its guides.

FIGS. 3*a* and 3*b* show a two roller system. This includes two so-called NIPCO-F rollers. The roller sleeve 13 is supported via pressure rams 42 on the yoke 15, where these pressure rams can be selectively activated via a chamber 43 and an oil conduit 44, as shown by the arrows in FIG. 3*a* in the region of the pressure rams. The outer edge of the roller sleeve 13 is supported via a bearing 40 on a connecting member 38. This connecting member is movable vertically on a guide of the yoke 15, as indicated by the arrow in FIG. 3*b*. Thus it can be moved vertically relative to the yoke 15 in dependence upon the pressure force exerted by the pressure rams on the applied pressing force, along the corresponding vertical guide surfaces 50. The mentioned seizing can occur there as a result of the increased friction. The movement of the roller sleeve 13 relative to the yoke 15 can be determined by a displacement transducer 46. Here, the possibility exists of compensating disharmony of the pressing forces in the event of seizure occurring solely by use of simple software control.

What is claimed is:

1. A system for calendering a material web having a flat surface with opposing first and second sides, said system comprising:

a frame;

at least one fixed roller mounted on the frame and positioned relative to the first web side, the fixed roller having a fixed roller surface that contacts the first web side, the fixed roller surface having a first end and a second end arranged along a rotation axis which extends along the web surface, each of the first and second ends of the fixed roller surface being movable towards and away from the first web side in a predetermined direction and within a limited predetermined range of movement relative to the frame so that a pressing force across the fixed roller surface against the first web side is variable;

at least one movable roller positioned relative to the second web side having a movable roller surface that includes a first end and a second end arranged along a rotation axis which extends along the web surface;

the first and second movable roller ends each including guides interconnected with the frame so that the movable roller slides along the frame to move toward and away from the web surface in the predetermined direction over a second predetermined range of movement that is substantially greater than the first predetermined range of movement, the movable roller being constructed and arranged to move substantially freely in the predetermined direction toward and away from the second web side so that the movable roller surface provides a pressing force to the second web side wherein the web is pressed between the movable roller surface and the fixed roller surface;

a sensor, located in relation to the first fixed roller end and responsive to a load change at the first fixed roller end caused by a seizure of the first movable roller end in the frame that obstructs movement of the first movable roller end in the predetermined direction toward or away from the second web side to press on the second web side which, in turn, enlarges, maintains or reduces the pressing force thereof on the first fixed roller end, the sensor generating a first load signal in response to an alteration of pressing force thereon;

a sensor, located in relation to the second fixed roller end and responsive to a load change at the second fixed roller end caused by a seizure of the second movable roller end that obstructs movement of the second movable roller end in the predetermined direction toward or away from the second web side to press on the second web side which, in turn, enlarges, maintains or reduces the pressing force thereof on the second fixed roller end, the sensor generating a second load signal in response to an alteration of pressing force thereon; and a controller, responsive to each of the first and the second load signals, that independently varies the pressing force present at each of the first and second fixed roller ends respectively with respect to the web surface by moving the first or the second fixed roller end towards or away from the first web side until a load at the respective load sensor is attained which corresponds to the load applied to the movable roller guides.

2. A system according to claim 1 wherein at least one of a plurality of fixed rollers and a plurality of movable rollers are provided.

3. A system according to claim 1 wherein the calendering system comprises a vertical calender having a plurality of rollers oriented from a lowermost position to an uppermost position and the fixed roller comprises an uppermost roller in the vertical calender.

4. A system according to claim 1 wherein the calendering system comprises a vertical calender having a plurality of rollers oriented from a lowermost to an uppermost position and the fixed roller comprises a lowermost roller in the vertical calender.

5. A system according to claim 1 wherein the calendering system comprises a horizontal calender having a plurality of rollers oriented from left to right and the fixed roller comprises an outermost right hand roller in the horizontal calender.

6. A system according to claim 1 wherein the fixed roller comprises an outermost left hand roller in the horizontal calender.

7. A system according to claim 1 further comprising a second movable roller positioned opposite the movable roller so that the fixed roller is positioned between the movable roller and second movable roller.

8. A system according to claim 1 wherein the fixed roller comprises a deflection equalization roller having a yoke and an outer roller sleeve coaxial with the yoke, the sleeve being rotatable relative to the yoke and laterally fixed relative to the yoke and the means for moving comprising a movable intermediate support positioned at each end of the yoke.

9. A system according to claim 1 wherein the fixed roller comprises a deflection equalization roller having a yoke and an outer sleeve coaxial with the yoke, the sleeve being rotatable relative to the yoke, the means for moving comprising means for laterally realigning an axis of rotation of the sleeve relative to the yoke.

10. A system according to claim 1 further comprising means for applying a predetermined and measurable supplementary load to the movable roller.

11. A system according to claim 10 wherein the means for applying includes one of hydraulic and pneumatic pressure means to operate the means for moving and the means for generating the first and second pressing force signals each include means for measuring one of hydraulic and pneumatic pressure generated by the pressure means.

12. A system according to claim 1 wherein at least one of the means for generating the first and second position signals comprises at least one load cell.

13. A system according to claim 1 wherein the means for varying comprises a jacking device.

14. A system according to claim 1 wherein the means for varying comprises one of a hydraulic and a pneumatic piston system.

15. A system according to claim 1 wherein the means for independently varying includes a position controller that compares the position of each of the first and second movable roller ends in the frame against predetermined desired positions for each of the first and second movable roller ends, the position controller including a signal generator for directing each of the first and second movable roller ends to move into the predetermined desired positions.

* * * * *